United States Patent [19]

McClimon

[11] 4,326,717

[45] Apr. 27, 1982

[54] GOLF DRIVING TARGET APPARATUS

[76] Inventor: Robert A. McClimon, 1451 N. Chester, Indianapolis, Ind. 46201

[21] Appl. No.: 121,222

[22] Filed: Feb. 13, 1980

[51] Int. Cl.[3] ..... A63B 69/36

[52] U.S. Cl. ..... 273/181 F; 273/DIG. 4; 273/DIG. 7

[58] Field of Search ..... 273/181 A, 181 E, 181 F, 273/26 A, DIG. 4, DIG. 7

[56] References Cited

U.S. PATENT DOCUMENTS

| | | | |
|---|---|---|---|
| 1,469,130 | 9/1923 | Whitehair | 273/181 A |
| 2,873,969 | 2/1959 | Ziel | 273/181 A X |
| 2,944,816 | 7/1960 | Dixon | 273/181 F X |
| 3,367,661 | 2/1968 | Dean | 273/181 E |
| 3,601,406 | 8/1971 | Giuste | 273/181 B |
| 3,672,672 | 6/1972 | Rubin | 273/26 A |
| 3,810,616 | 5/1974 | Murphy | 273/DIG. 4 |
| 3,963,240 | 6/1976 | Tidewell | 273/16 A X |
| 3,986,719 | 10/1976 | Lee | 273/181 F |

FOREIGN PATENT DOCUMENTS

| | | | |
|---|---|---|---|
| 408944 | 4/1934 | United Kingdom | 273/181 F |
| 1208442 | 10/1970 | United Kingdom | 273/DIG. 4 |

*Primary Examiner*—George J. Marlo

*Attorney, Agent, or Firm*—Woodard, Weikart, Emhardt & Naughton

[57] ABSTRACT

A lightweight, portable golf target apparatus, which can be quickly and easily assembled and disassembled, and can be used in confined outdoor areas and in the indoors. A multilayered target having a front layer of 20 gauge fiberglass mesh and underlayers of five mil polyethylene film is attached to an inverted "y" wood frame by elastic bands, and imparts only a small amount of rebounding force to a driven golf ball. The frame can be disassembled into a number of color coded parts, and can be fixed to the ground by stakes. A flat bottom base is attachable for indoor use.

2 Claims, 5 Drawing Figures

GOLF DRIVING TARGET APPARATUS

BACKGROUND OF THE INVENTION

1. Field of the Invention

The field of the invention is golf apparatus, more particularly the field of the invention is golf target apparatus which is useful for practicing golf in a confined area.

2. Description of the Prior Art

Golf has become an extremely popular sport in this country. Although the sport is quite popular, it is difficult to enjoy on a regular basis because it is both time consuming and requires a large area of land in order to be played. Even practicing the game requires a large field in order to hit the longer distance clubs such as the driver.

Various types of equipment have been devised in an attempt to bring some of the enjoyment of golf to the backyard. One such device is described in U.S. Pat. No. 3,986,719 to Lee. The Lee device has a net which is hung from a portable "rocking" frame. Upon impact by a golf ball, the frame rocks backward to sustain the force. The bottom portion of the net has a pocket which is intended to receive the golf ball after the impact. U.S. Pat. No. 1,469,130 to Whitehare discloses another device which is designed to catch and retain a golf ball.

Other target devices in the prior art are intended to catch and return a ball, such as a baseball. Examples of such devices are U.S. Pat. No. 2,944,816 to Dixon, U.S. Pat. No. 2,873,969 to Ziel, and U.S. Pat. No. 3,963,240 to Tidwell.

U.S. Pat. No. 3,601,406 to Giusti discloses a golf practicing apparatus in which a specially made golf ball adheres to the target upon impact.

U.S. Pat. No. 3,367,661 to Dean discloses a target system which is used for practice driving ranges, and is designed to signal an alarm when the target is hit by a golf ball.

SUMMARY OF THE INVENTION

The present invention relates to golf driving target apparatus which can be successfully used in confined areas such as backyards and indoors. One feature that is desirable for such apparatus is that it be lightweight and portable. The apparatus must also be able to withstand the impact of a golf ball without damage. The velocity of a driven golf ball can often be well in excess of 100 miles per hour. The apparatus must be able to withstand this impact, yet only imparts a small amount of rebounding force to the ball. Otherwise, the ball would unpredictably careen off the apparatus with the possibility of causing damage or injury.

In one embodiment of the present invention, a multilayered target is attached to a portable, lightweight frame by means of elastic bands. The multiple layers of the target are formed by a first layer of fine fiberglass mesh, and second and third layers of polyethylene film. This embodiment of the present invention reacts elastically to an impact by a golf ball of relatively small velocity, however has a substantially inelastic reaction to a high velocity impact. As a result, even the hardest hit golf ball only rebounds lightly off of the target.

DESCRIPTION OF THE PREFERRED EMBODIMENT

Figure 1:
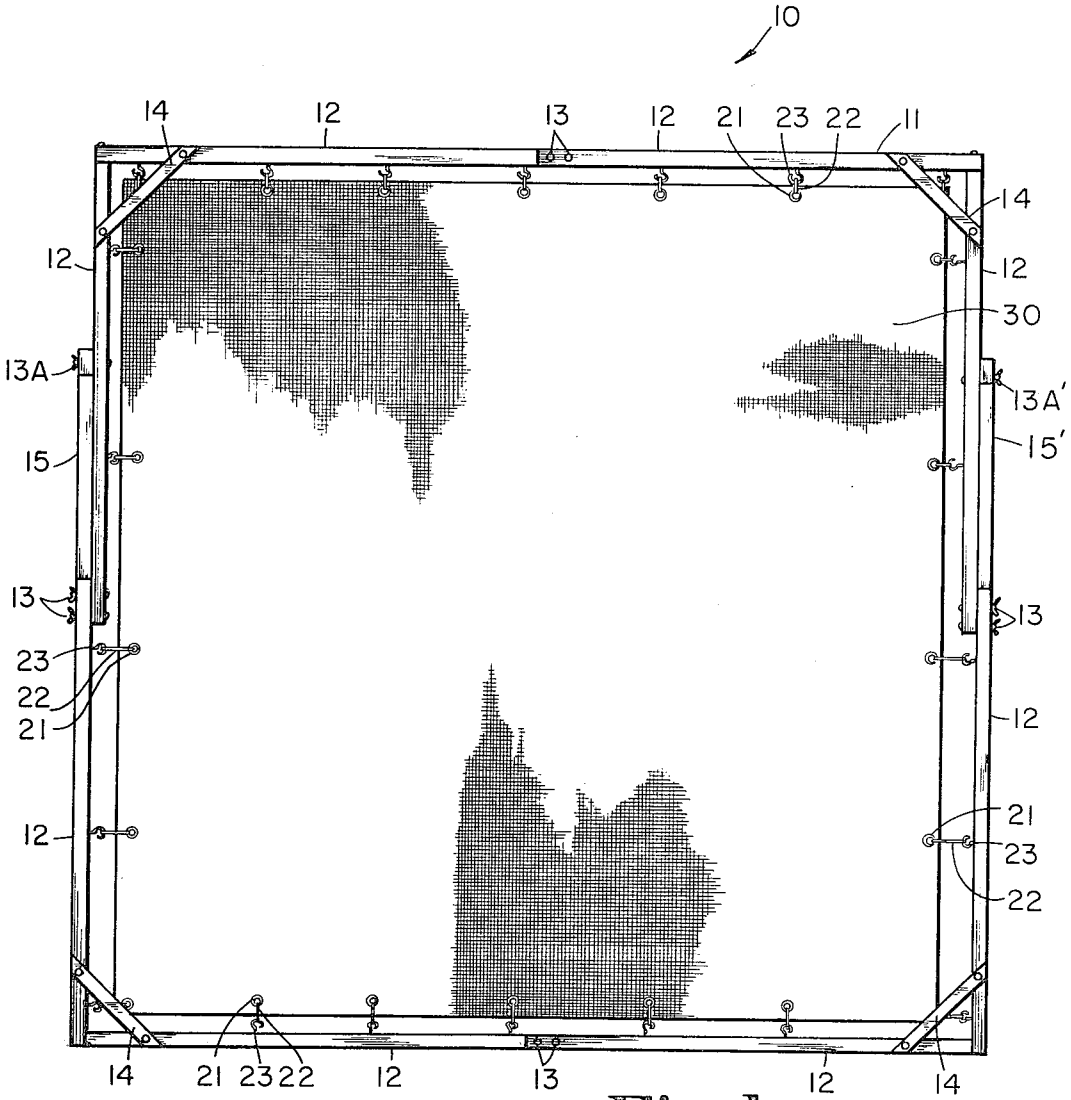
FIG. 1 is a front elevational view of a golf driving target apparatus.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings, in one specific embodiment of the invention frame 11 is formed by $\frac{3}{4}$ inch by $\frac{3}{4}$ sticks of wood 12 the majority of which are thirty-three inches long. Sticks of wood 12 are connected to each other by bolt and wing nut combinations 13. Braces 14 connect the corners of frame 11 at a 45° angle for additional strength and are also attachable and detachable by bolts and wing nuts. Legs 15 and 15' are attached to the side of frame 11, by bolt and wing nut combinations 13A and 13A' respectively.

Figure 2:
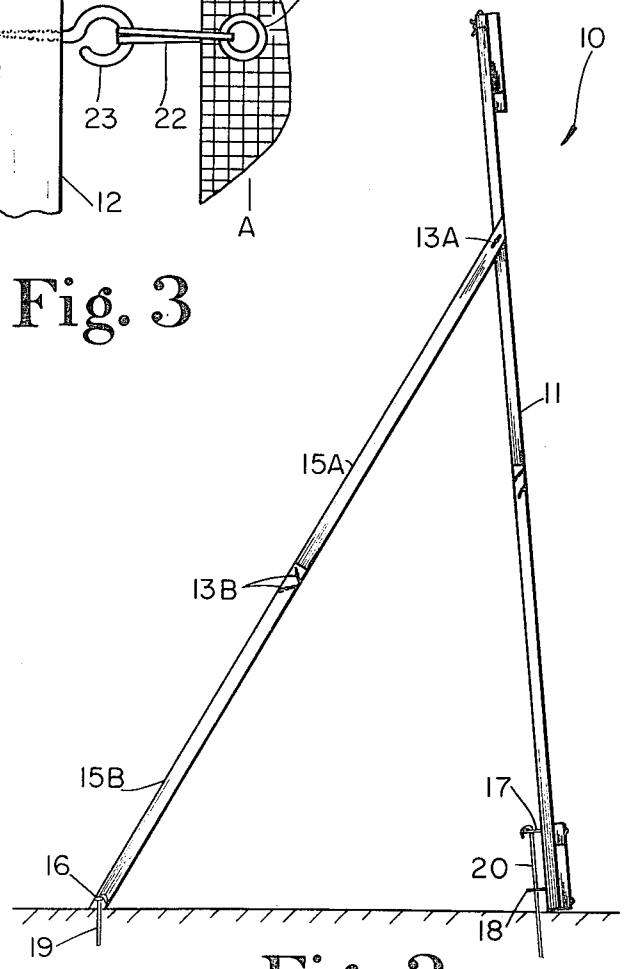
FIG. 2 is a side elevational view of the golf driving apparatus of FIG. 1.

In FIG. 2, it can be seen that leg 15 is formed by two sticks of wood 15A and 15B, which are connected to each other by bolt and wing nut combinations 13B. At its base, stick 15B has a hole. Stake 19 is inserted through this hole and into the ground to provide stability. Also, eyelets 17 and 18 are attached to frame 11 near to its base. Stake 20 is inserted through these eyelets and into the ground to provide additional stability. FIG. 2, as above described shows the view of one side of apparatus 10. A view of the opposite side of apparatus 10 would reveal identical structure, with leg 16 having the same structure as leg 15 and with eyelets and stakes maintaining frame 11 in fixed position with the ground.

Figure 3:
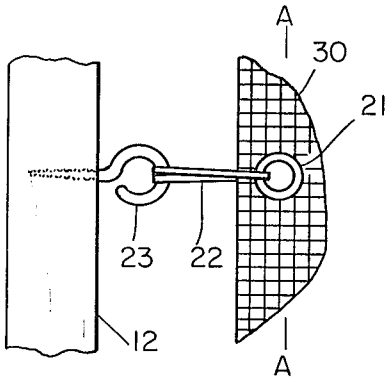
FIG. 3 is an enlarged partial fragmentary view of the apparatus of FIGS. 1 and 2, showing attachment of the target to the frame.
Figure 5:
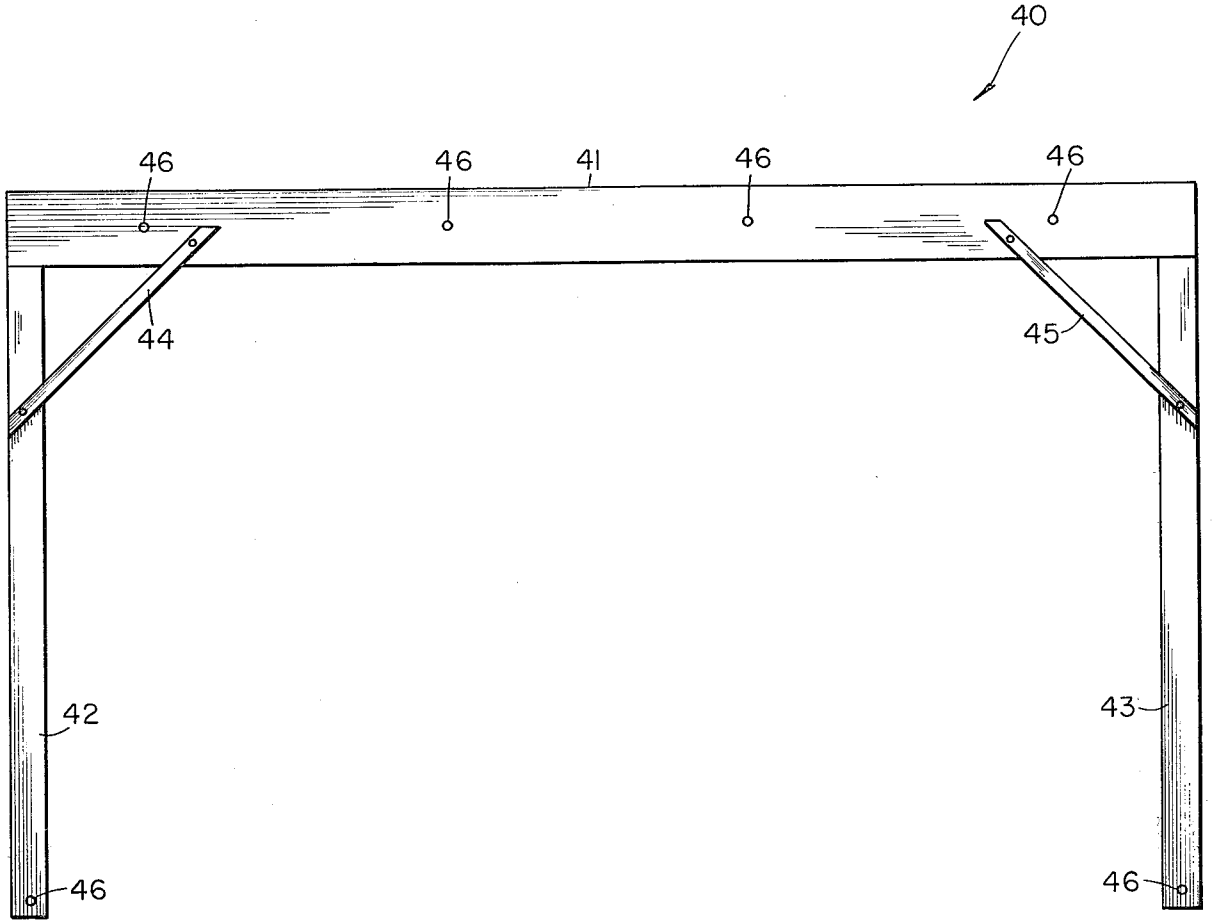
FIG. 5 is a top plan view of a base for attachment with the frame of FIGS. 1–3, and is intended for indoor use of the apparatus.

Target 30 has formed about its circumference a number of eyelets 21. Elastic bands 22 attach target 30 to frame 11 by connecting between eyelets 21 and eyelets 23, which are attached to frame 11. FIG. 3 is an enlarged view of one such connection. From FIG. 3 it can be seen that elastic band is connected at one end to eyelet 23, passes through eyelet 21, and is connected at the other end again to eyelet 23.

Figure 4:
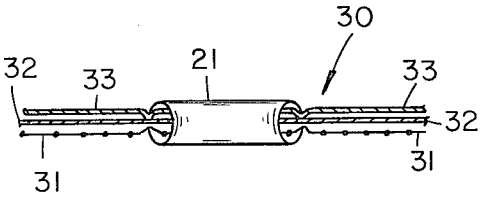
FIG. 4 is an enlarged partial fragmentary view of the multilayered target of the apparatus illustrated in FIGS. 1–3, sectioned along lines A—A of FIG. 3.

FIG. 4 illustrates a cross-sectional view of a portion of the multilayered target 30, sectioned along lines A—A of FIG. 3. The first layer 31 of target 30 is formed by a fine fiberglass mesh of about twenty gauge. The second layer 32 is of polyethylene film. Polyethylene film of four mil thickness has been tested and found to be satisfactory. It is believed that the thickness of the film should desirably be about five mils in thickness. The third layer 33 is also polyethylene film and should be of the same thickness as the second layer 32.

Base member 40 is constructed to hold frame 11 for indoor use. Base member 40 includes a front base 41, and two side bases 42 and 43 which are connected to each end of front base 41. Braces 44 and 45 attach front base 41 to side bases 42 and 43 respectively, and provide additional stability. Holes have been drilled at locations 46 for screws to anchor frame 11 to base member 40. It may be desirable to use small suction cups or a high frictional material on the bottom of base member 40 in order to provide extra gripping to a floor. While although apparatus 10 may have the stability to be used on a flat hard surface without the use of stakes 16 and 17, base member 40 provides the desired stability in order to be safely and satisfactorily used indoors.

The combination of the elastic bands, the mesh, and the layers of polyethylene film provide an extremely suitable target for a driven golf ball. If a ball hits the target lightly, it will lightly rebound due to the elastic property of the elastic bands. However, harder impacts are partially absorbed by the mesh and the films which slightly stretch and deform about the point of impact, yet the materials are strong enough to withstand the impacts without damage. In this way the force of the impact is absorbed, and there is a diminished rebounding force. Therefore, even with a hard impact by a golf ball, the ball bounces off only lightly from the target.

The preferred embodiment as above described, is also lightweight and portable. It can be easily assembled and disassembled and can be used in virtually any indoor location or in any confined outdoor area. In the above described specific embodiment, the short (33") length of each piece 12 makes possible packaging the device in a relatively small package for marketing, transporting and storing.

For ease of assembly, each side of frame 11 is a different color. For example, the top may be white, the bottom green, and the two sides red and blue. Also, each end of braces 14 has the color of the corresponding side to which it is to be attached, and legs 15 and 15' have the same colors as the sides to which they are attached. And eyelets 21 are also of the same color as their corresponding sides. This color coding feature allows a person to completely assembly the target apparatus simply and easily, in a small amount of time.

While there have been described above the principles of this invention in connection with specific apparatus and techniques it is to be clearly understood that this description is made only by way of example and not as a limitation to the scope of the invention.

What is claimed is:

1. Golf driving target apparatus for stopping a driven golf ball and imparting to the golf ball only a small amount of rebounding force, said apparatus comprising a fixedly positioned frame; a plurality of elastic bands; and a multilayered target, said target having a first, front layer of fine fiberglass mesh, and behind said layer of fine mesh, a second layer of polyethylene film, and behind said second layer, a third layer, said third layer being of polyethylene film, said target being circumferentially attached to said frame by said elastic bands.

2. The golf driving apparatus of claim 1 in which said second and third layers of polyethylene film each has a thickness of about 5 mil, and the fiberglass mesh is of about 20 gauge size.

* * * * *